US006902005B2

(12) United States Patent
Radi et al.

(10) Patent No.: US 6,902,005 B2
(45) Date of Patent: Jun. 7, 2005

(54) TUBING ANNULUS COMMUNICATION FOR VERTICAL FLOW SUBSEA WELL

(75) Inventors: Amin Radi, Nassau Bay, TX (US); Michael E. Capesius, Santa Paula, CA (US); Fife B. Ellis, Houston, TX (US); Robert K. Voss, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 174 days.

(21) Appl. No.: 10/366,241

(22) Filed: Feb. 13, 2003

(65) Prior Publication Data

US 2003/0155126 A1 Aug. 21, 2003

Related U.S. Application Data

(60) Provisional application No. 60/357,230, filed on Feb. 15, 2002.

(51) Int. Cl.[7] ..... E21B 34/04

(52) U.S. Cl. ..... 166/345; 166/348; 166/368

(58) Field of Search ..... 166/345, 348, 166/350, 359, 367, 368

(56) References Cited

U.S. PATENT DOCUMENTS 4,632,188 A * 12/1986 Schuh et al. ..... 166/368
4,967,842 A * 11/1990 Franceschini et al. ..... 166/345
5,941,310 A * 8/1999 Cunningham et al. ..... 166/345
6,186,237 B1 * 2/2001 Voss et al. ..... 166/348
6,293,345 B1 * 9/2001 Watkins ..... 166/368
6,302,212 B1 * 10/2001 Nobileau ..... 166/368
6,659,181 B2 * 12/2003 Hartmann ..... 166/348
6,719,059 B2 * 4/2004 Dezen et al. ..... 166/368
6,755,254 B2 * 6/2004 DeBerry ..... 166/368

FOREIGN PATENT DOCUMENTS

EP 0 152 263 B1 7/1989

* cited by examiner

*Primary Examiner*—Frederick L. Lagman
(74) *Attorney, Agent, or Firm*—Bracewell & Giuliani LLP

(57) ABSTRACT

A subsea wellhead assembly allows communication between a production tubing annulus and a conduit in fluid communication with a platform above. The wellhead assembly has a tubing hanger that is held relative to a tubular wellhead member of a subsea well by a tubing hanger support. A string of tubing extends from the tubing hanger into the well, defining an annulus around the tubing. The conduit communicates with the tubing annulus through a tubing annulus passage. The tubing annulus passage has a portion extending through the tubing hanger support. The wellhead member supports a valve block located between the tubing hanger support and the riser. The tubing annulus passage has another portion that registers with the portion of the passage in the tubing hanger support. The conduit stabs into valve block portion of the tubing annulus passage when the riser connects to the upper end of the valve block.

22 Claims, 6 Drawing Sheets

TUBING ANNULUS COMMUNICATION FOR VERTICAL FLOW SUBSEA WELL

RELATED APPLICATIONS

Applicant claims priority for the invention described herein through a United States provisional patent application titled "Tubing Annulus Communication for Vertical Flow Subsea Well," having U.S. patent application Ser. No. 60/357,230, which was filed on Feb. 15, 2002, and which is incorporated herein by reference in its entirety.

BACKGROUND OF INVENTION

1. Field of the Invention

This invention relates in general to subsea well production, and in particular to a subsea well that has vertical production passages and tubing annulus communication other than through the tubing hanger.

2. Background of the Invention

A subsea well that is capable of producing oil or gas will have an outer or low pressure wellhead housing secured to a string of conductor pipe that extends some short depth into the well. An inner or high pressure wellhead housing lands in the outer wellhead housing. The tubular wellhead member is secured to an outer string of casing, which extends through the conductor pipe to a deeper depth into the well. Depending on the particular conditions of the geological strata above the target zone (typically, either an oil or gas producing zone or a fluid injection zone), one or more additional casing strings will extend through the outer string of casing to increasing depths in the well until the well is to the final depth.

The last string of casing extends into the well to the final depth, this being the production casing. The strings of casing between the first casing and the production casing are intermediate casing strings. When each string of casing is hung in the wellhead assembly, a cement slurry is flowed through the inside of the casing, out of the bottom of the casing, and back up the outside of the casing to a predetermined point. A tubing hanger typically connects to the wellhead assembly. When a string of production tubing is lowered into the well and supported by the tubing hanger, a tubing annulus is defined between the outer surface of the production tubing and the innermost or production casing. At a lower portion of the production tubing, a seal system or packer is typically connected to the outer surface of the production tubing and the inner surface of the production casing. After the production casing is perforated, well fluids enter the well through the perforations to communicate up the interior of the production tubing to the wellhead.

Sometimes it is desirous for a heavy fluid or "kill" fluid to be pumped either through the tubing or from the tubing annulus past the packer so that the operator can stop production from the well before removing the string of production tubing. In situations where the heavy fluid is pumped down the tubing annulus, the packer may be released for allowing fluid to flow below the packer to the interior of the tubing.

Additionally, operators desire a means of communicating and monitoring pressure of producing wells in the production tubing annulus. Normally there should be no pressure in the production tubing annulus because the annular space is sealed with the packer. If pressure increased within the production tubing annulus, it would indicate that a leak exists in one of the strings of casing or in the tubing. The leak could be from several places. Regardless of where the leak is coming from, pressure build up in the production tubing annulus could collapse a portion of the production tubing, compromising the structural and pressure integrity of the well. For this reason, operators typically monitor the pressure in the production tubing annulus between the production casing and the production tubing.

In one type of wellhead assembly, the tubing hanger has an offset passage through it for communicating with the tubing annulus. In this type, the tubing hanger lands in the wellhead housing or in a tubing spool above the wellhead housing. In small diameter tubing hangers, there may not be enough space for the tubing annulus passage. In another type, the tubing hanger lands in a production tree mounted on the wellhead housing. A bypass passage extends through the tree around the tubing hanger for communicating with the tubing annulus.

BRIEF SUMMARY OF THE INVENTION

With the foregoing in mind, a subsea wellhead assembly has a tubular wellhead housing or member and a tubing hanger support attached to an upper portion of the wellhead member. A tubing hanger lands on the tubing hanger support. A string of production tubing extends from the tubing hanger to a desired depth. The string of production tubing defines a production tubing annulus, or tubing annulus, around the outer circumference of the tubing.

The wellhead assembly also includes a riser assembly that is lands on the wellhead member. The riser assembly is in communication with the string of tubing and extends to a platform at the surface of the sea. Well fluid flows up the interior of the production tubing and through the riser to the platform at the surface. The wellhead assembly also includes a conduit extending alongside the riser. The conduit is in fluid communication with the platform. The wellhead assembly also has a passage or tubing annulus passage extending from the tubing annulus through the tubing hanger support that communicates with the conduit.

Preferably, a valve block is also included in the wellhead assembly. The valve block is supported by the tubular wellhead member between the tubing hanger and the riser. The valve block has a passageway that communicates with the interior of the production tubing and the riser so the well fluids flow through the valve block from the well to the platform. The valve block contains at least one valve for regulating the flow of well fluids entering the riser from the well.

A portion of the tubing annulus passage extends through the tubing support to a stab receptacle connected on an upper portion of the tubing support. The valve block has another portion of the tubing annulus passage that stabs into the stab receptor on the tubing support or adapter. The valve block portion of the tubing annulus passage extends generally up the axial length of the valve block to a stab receptacle mounted to the upper portion of the valve block. When the riser assembly connects to the rest of the wellhead assembly, a stab stabs into the stab receptacle on the valve block and connects the conduit to the tubing annulus passage.

In one of the embodiments, the tubing support is an adapter that lands in the bore of the tubular wellhead member. In this embodiment, the valve block attaches to a grooved profile on the outer surface of the tubular member. In the other embodiments, the tubing support is a tubing spool, and the valve block attaches to a grooved profile on the outer surface of the valve block. The valve block portion of the tubing annulus passages can be a passage extending through the axial length of the valve block, or the combination of a passage through a portion of the valve block and then to a tubular member running alongside the valve block, or a tubular member running alongside through the valve block. In either embodiment, the valve block portion of the tubing annulus passage stabs into the stab receptacle attached to the tubing support.

DETAILED DESCRIPTION OF THE INVENTION

Figure 1A:
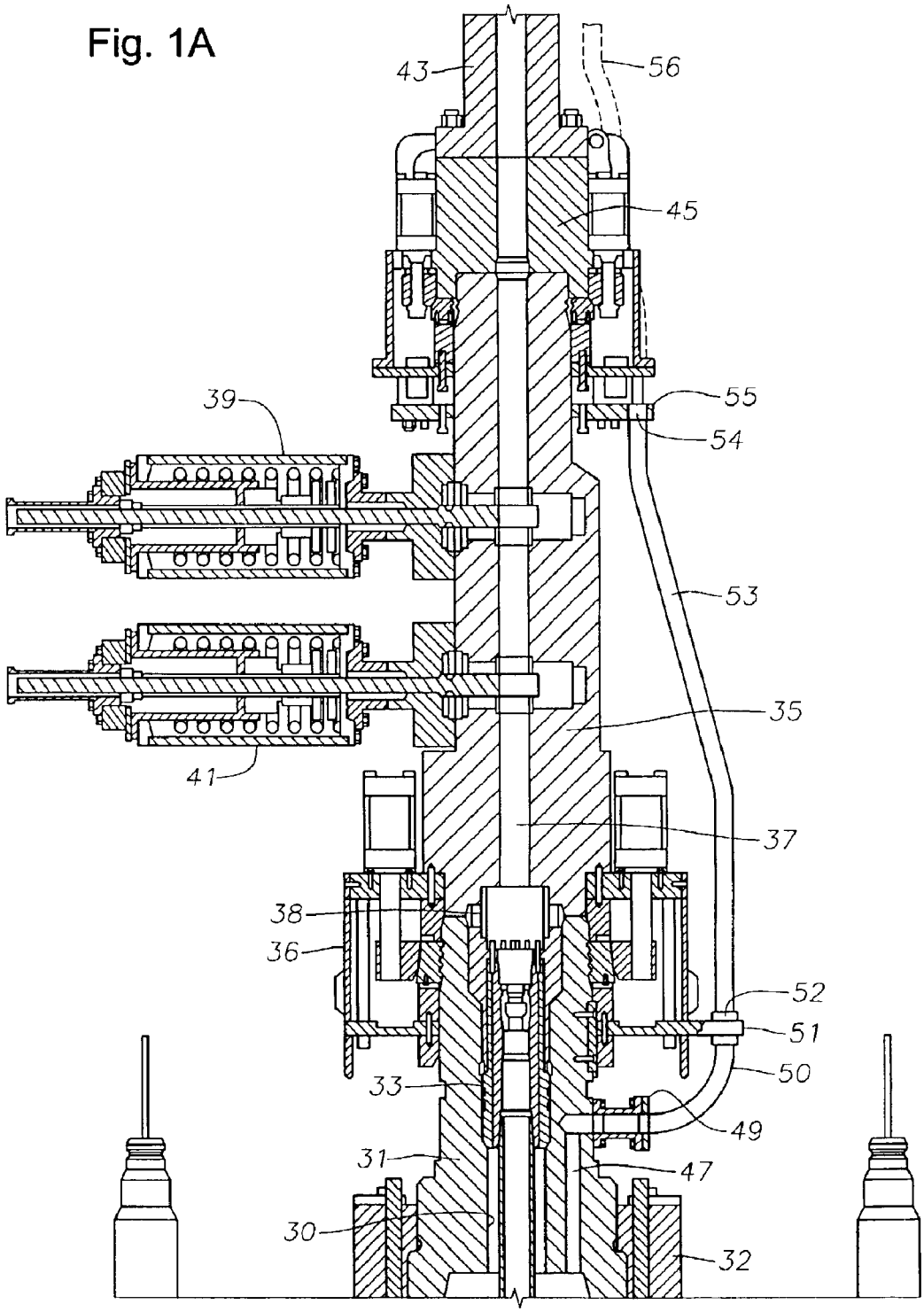
FIGS. 1A and 1B comprise a vertical sectional view of a subsea well constructed in accordance with this invention.
Figure 1B:
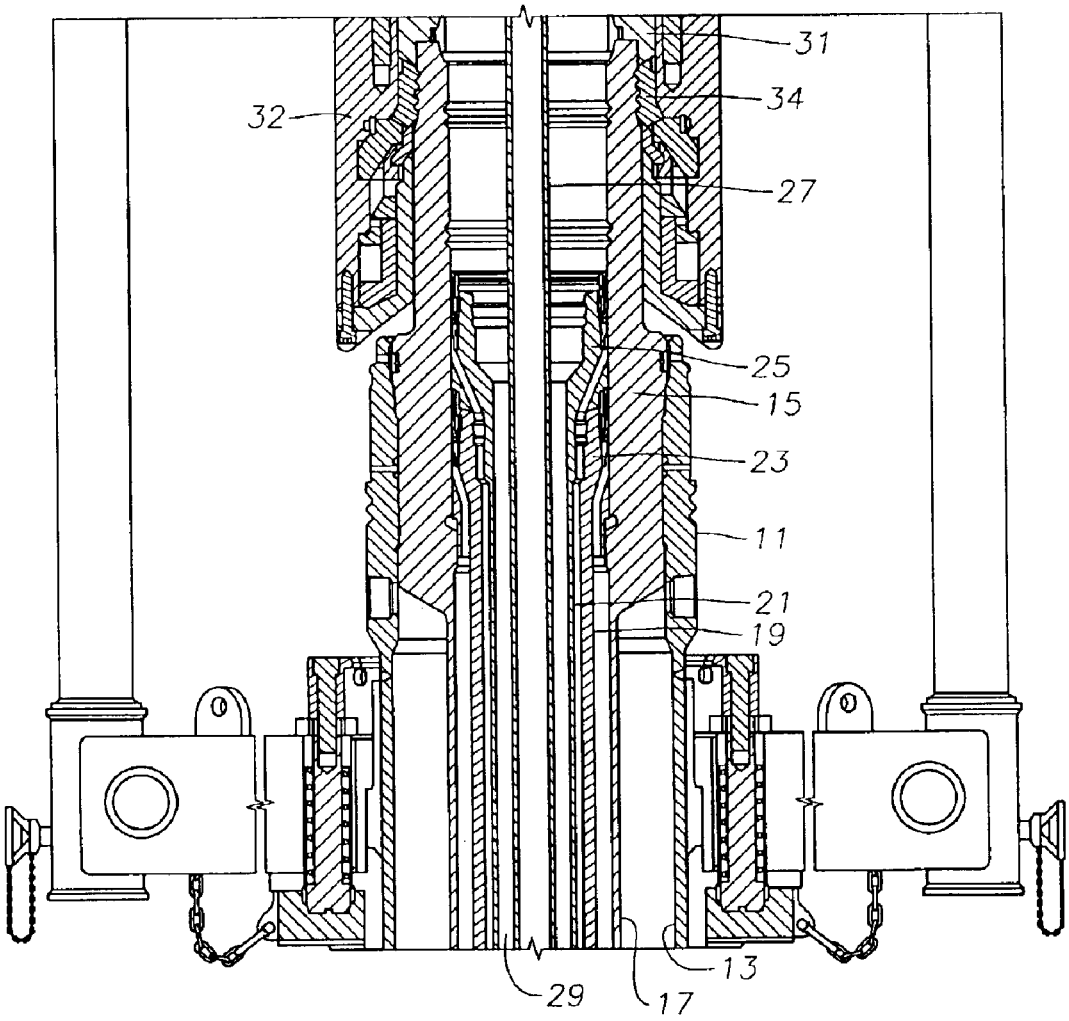

Referring to FIG. 1B, an outer or low pressure wellhead housing 11 is located at the sea floor. A large diameter pipe or conductor 13 extends into the well to the first depth. An inner or high pressure housing 15 lands in outer wellhead housing 11. High pressure wellhead housing or tubular wellhead member 15 has a large diameter string of casing 17 that extends into the well to a second depth and is cemented in place. In this well, there are two strings of casing 17 and 19, each extending to a greater depth. Each string of casing, 19, 21 is supported by a casing hanger 23, 25, respectively, within the bore of inner wellhead housing 15.

A string of production tubing 27 extends through the smallest diameter casing 21. The well will produce fluids through tubing 27. A production tubing annulus or tubing annulus 29 exists between tubing 27 and the production casing or smallest diameter casing 21. It is important to monitor the tubing annulus 29 for leakage and also to be able to circulate fluids through tubing annulus 29. For example, tubing annulus 29 circulation is normally performed when the well is being killed by loading tubing 27 and tubing annulus 29 with a fluid that is heavier than the formation fluid. This invention deals with different techniques for communicating tubing annulus 29 to a production vessel at the surface.

A tubing hanger support, or in the first embodiment, a tubing spool 31, shown in FIG. 1A and 1B, has a bore 30 and mounts to the upper end or mandrel of wellhead housing 15. A connector 32 connects tubing spool 31 to an external profile on the mandrel of wellhead housing 15. Connector 32 is typically hydraulically actuated and may comprise a type using either dogs 34 or a collet (not shown). A tubing hanger 33 lands within bore 30 of tubing spool 31 and supports the string of tubing 27. Tubing hanger 33 has a single production passage extending through it. Tubing hanger 33 may also have ancillary passages extending through it for communicating with a downhole safety valve, chemical injection and the like.

A valve block 35, which has similarities to a Christmas tree, lands on top of spool 31 in the first embodiment. Valve block 35 is a large tubular member having a vertical production passage 37 extending through it. The outlet of passage 37 for the produced fluids is vertical rather than horizontal as in a conventional Christmas tree. An isolation sleeve 38 on the lower end of production passage 37 communicates passage 37 with the interior of tubing hanger 33 and tubing 27. A pair of valves 39, 41 mounted to valve block 35 serve to open and close production passage 37. Production passage 37 extends vertically through valve block 35 and delivers production fluid to the interior of a production riser 43 that extends upward to a platform at the surface. Riser 43 connects to valve block 35 by means of a riser connector 45, which may be of a type utilizing dogs, collets or bolted flange. A surface Christmas tree (not shown) is located on a surface platform and connected to riser 43.

Tubing annulus 29 is in communication with a void space within the bore of wellhead housing 15 surrounding tubing 27. This void space within the bore of wellhead housing 15 communicates with a similar void space within tubing spool 31. A tubing annulus passage 47 extends upward a selected distance from the void space within tubing spool 31 parallel to and offset from tubing spool bore 30. A lateral portion of annulus passage 47 extends outward to an optional ROV (Remote Operator Vehicle) valve 49 on the side of tubing spool 31. A tubing annulus conduit 50 extends from valve 49 to a lower stab plate 51 mounted around tubing spool 31. A stab receptacle 52 is positioned at the end of annulus conduit 50 connected to stab plate 51. In the first embodiment, annulus passage 47 and conduit 50 define a tubing hanger support portion of a tubing annulus passage.

A tubing annulus conduit or pipe 53 extends alongside valve block 35. Conduit 53 is configured to stab into mating stab receptacle 52 in stab plate 51 when valve block 35 lands on tubing spool 31 so that it will communicate with conduit 50. Tubing annulus conduit 53 is secured to an upper stab plate 55, which is mounted to valve block 35 near its upper end. A stab receptacle 54 is positioned at the end of annulus conduit 53 connected to stab plate 55. A conduit 56 extends alongside riser 43 to the surface vessel and has a lower end that stabs into upper receptacle 54 which is in communication with tubing annulus conduit 53. In the first embodiment, tubing annulus conduit 53 defines a valve block portion of the tubing annulus passage. In the first embodiment, valve block portion and the tubing hanger support portion of the tubing annulus passage allow communication between conduit 56 and production tubing annulus 29.

In operation, the well is first drilled and cased as shown in FIG. 1B. Then the operator lowers tubing spool 31 and secures tubing spool 31 to the mandrel of wellhead housing 15 by means of connector 32. Tubing 27 and tubing hanger 33 will be subsequently run, typically on a completion riser (not shown), with tubing hanger 33 landing in tubing spool 31. The operator may perforate and test the well at that time. The completion riser has a tubing annulus conduit that stabs into stab receptacle 52 on lower stab plate 51 to communicate tubing annulus 29 with the surface vessel via passage 47 and conduit 50.

Then, the operator will remove the completion riser and lower valve block 35 onto the upper end of tubing spool 31, preferably with production riser 43. Connector 36 will connect valve block 35 to spool 31. Prior to running, conduit 56 will be normally stabbed into engagement with the upper end of conduit 53 at upper stab plate 55. As valve block 35 lands on tubing spool 31, it will be oriented so that the lower end of conduit 53 will stab into engagement with conduit 50 at stab plate 51. Once installed, tubing annulus 29 can be monitored at the production platform via passage 47 and conduits 50, 53 and 56. Fluid can also be circulated through tubing annulus 29 by the same flow path. Production fluid flows up tubing 27, passage 37 and riser 43 to the surface tree on the platform at the surface.

If it is necessary to pull tubing hanger 33 and tubing 27, the operator will install a plug in tubing hanger 33 and close tubing annulus valve 49. The operator disconnects connector 36 from tubing spool 31 and removes valve block 35, preferably with production riser 43. Conduit 53 will release from engagement with conduit 50 at stab plate 51 as valve block 35 is lifted. The operator will connect a drilling riser (not shown) to the mandrel on valve spool 31. The drilling riser will have an auxiliary line that will stab into stab plate 51 for communication with tubing annulus conduit 50 and tubing annulus passage 47. Tubing 31 will be pulled through the drilling riser.

In the other embodiments, some of the elements which are the same will not be discussed again. In the first alternate embodiment, FIGS. 2A and 2B, tubing spool 57 has a tubing annulus passage 59 that extends from its lower end to its upper end, rather than to the sidewall as in FIG. 1A. In this embodiment, annulus passage 59 defines the tubing hanger support portion of the tubing annulus passage. A stab receptacle 60 is positioned at the upper end of annulus passage 59 on an upper surface of tubing spool 57. A stab 61 is located on the lower end of valve block 62 in communication with a tubing annulus passage 63 located within valve block 62. When valve block 62 is being landed on tubing spool 57, it will be oriented to align stab 61 with tubing annulus passage 59. A check valve 64 is located at the upper end of tubing annulus passage 59. When stab 61 lands in the upper end of tubing annulus passage 59, it opens check valve 64. When valve block 62 is lifted from tubing spool 57, check valve 64 closes. Alternately, check valve 64 could be a hydraulically actuated valve.

Figure 2B:
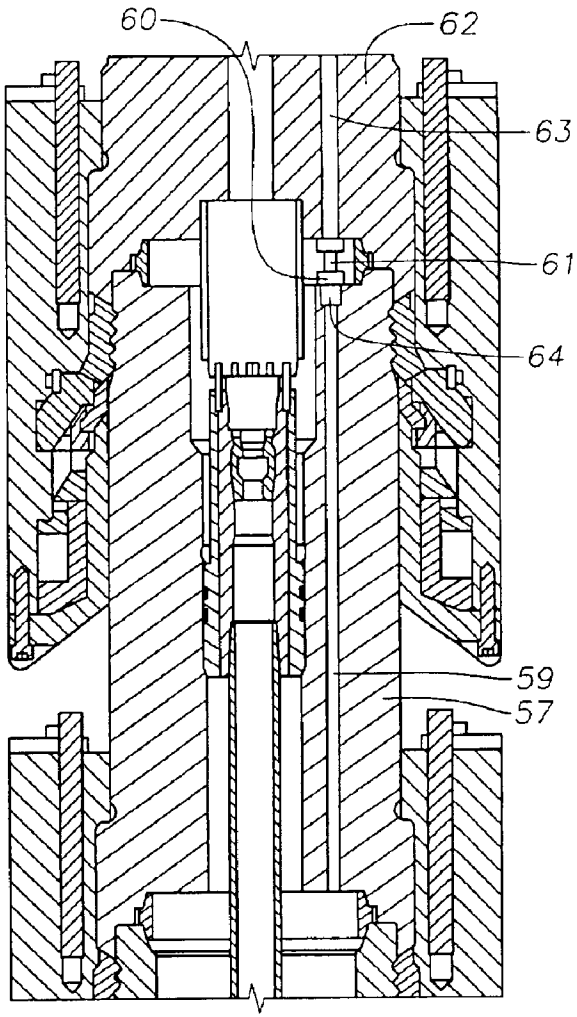
FIGS. 2A and 2B comprise a partial sectional view of an alternate embodiment of the subsea well of FIGS. 1A and 1B.
Figure 2A:
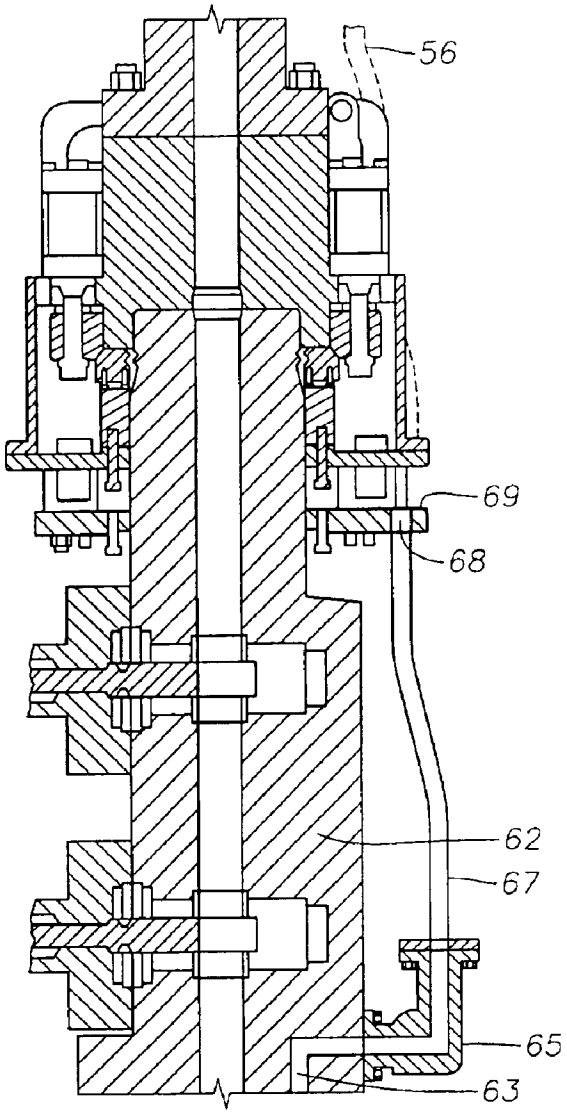

Passage 63 leads upward within valve block 62 to an optional ROV actuated valve 65 on its sidewall. A tubing annulus conduit 67 extends upward to a stab plate 69, which may be the same as stab plate 55 in the first embodiment. A stab receptacle 68 is positioned at the end of annulus conduit 67 connected to stab plate 69. In the embodiment shown in FIGS. 2A and 2B, passage 63 and conduit 67 define a valve block portion of the tubing annulus passage. The valve block portion and the tubing hanger support portion of the tubing annulus passage allow communication between conduit 56 and production tubing annulus 29. In the embodiment of FIGS. 2A and 2B, the operation is the same as in the first embodiment except there is no lower stab plate such as stab plate 51. Instead, when valve block 62 lands on tubing spool 57, tubing annulus communication will be established through stab 61 and check valve 64.

Figure 3B:
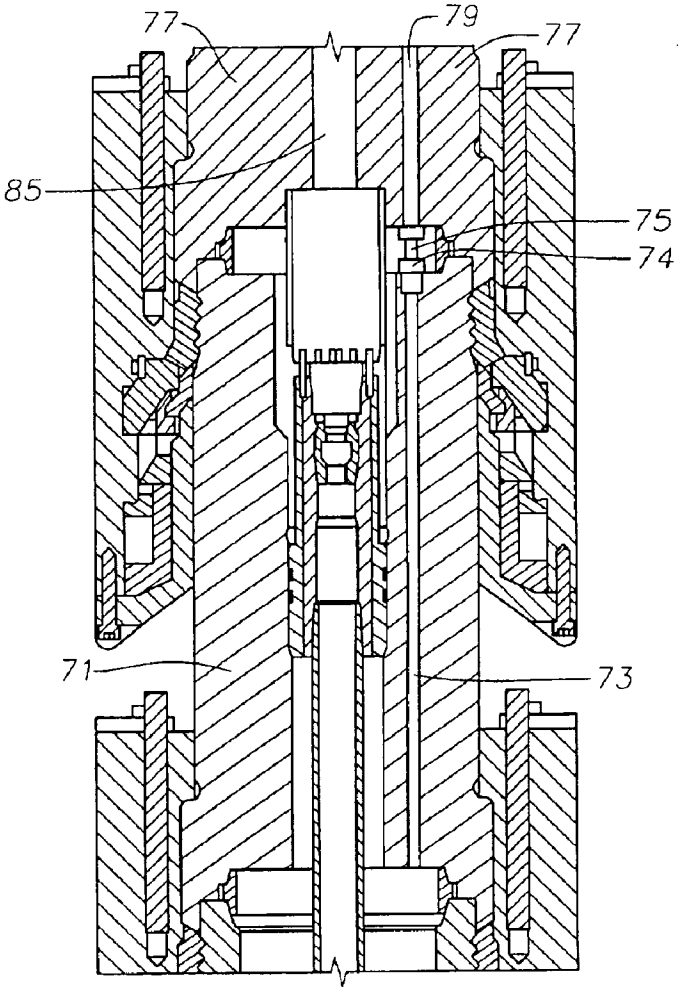
FIGS. 3A and 3B comprise a partial vertical sectional view of a second alternate subsea well constructed in accordance with this invention.
Figure 3A:
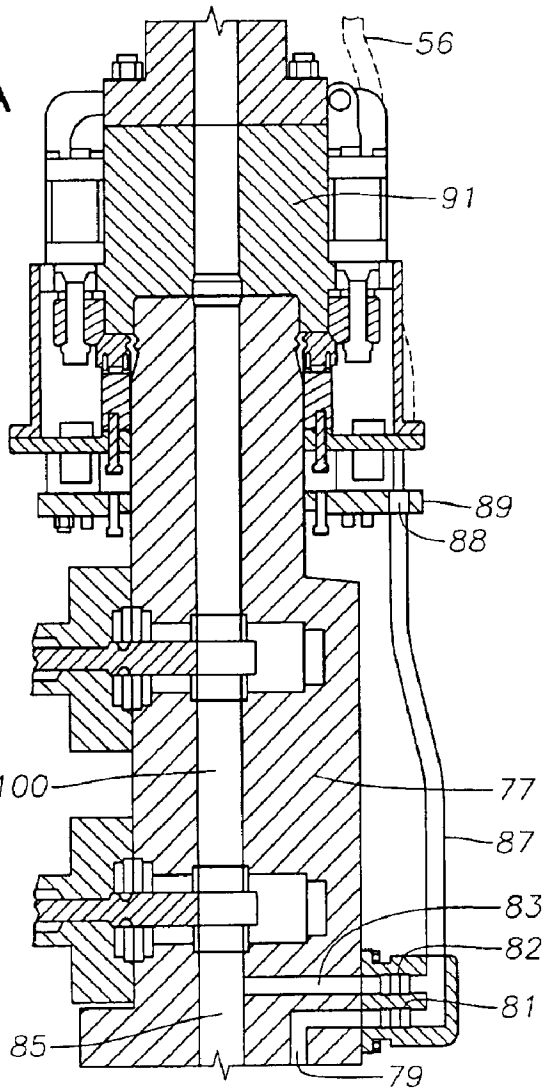

In the embodiment of FIGS. 3A and 3B, tubing spool 71 is configured the same as tubing spool 57 (FIG. 2B), having a tubing annulus passage 73 that extends completely through from the lower end to the upper end. In this embodiment, annulus passage 73 defines the tubing hanger support portion of the tubing annulus passage. A stab receptacle 74 is positioned at the upper end of annulus passage 73 on an upper surface of tubing spool 71. Alternately, tubing spool 71 could be configured as tubing spool 31 of FIG. 1A. In the embodiment of FIGS. 3A and 3B, a stab 75 stabs into stab receptacle 74 to connect tubing annulus passage 73 with a tubing annulus passage 79 in valve block 77. Tubing annulus passage 73 has a check valve at its upper end. Tubing annulus passage 79 extends upward to a dual valve assembly comprising valves 81, 82. Tubing annulus passage 79 leads to valve 81. A crossover passage 83 leads within valve block 77 from vertical production passage 85 to valve 82. Both valves 81, 82 selectively open and close to a tubing annulus conduit 87, which extends externally of valve block 77 to a stab plate 89. Stab plate 89 is mounted to valve block 77 and is configured the same as stab plate 69 of FIG. 2A and stab plate 55 of FIG. 1A. A stab receptacle 88 is positioned at the end of annulus conduit 87 connected to stab plate 89. Riser connector 91 will engage the upper end of valve block 77 and conduit 56 stabs into engagement with tubing annulus conduit 87 through stab receptacle 88 at stab plate 89. In the embodiment shown in FIGS. 3A and 3B, passage 79 and conduit 87 define a valve block portion of the tubing annulus passage.

In the operation of the embodiment of FIGS. 3A and 3B, the operator will normally close valve 82 and open valve 81 to communicate tubing annulus passage 73 with conduit 87 and the platform. Alternately, for certain operations, the operator may close valve 81 and open valve 82. This allows communication of annulus fluid in tubing annulus conduit 87 with production passage 85 through crossover passage 83.

Figure 4B:
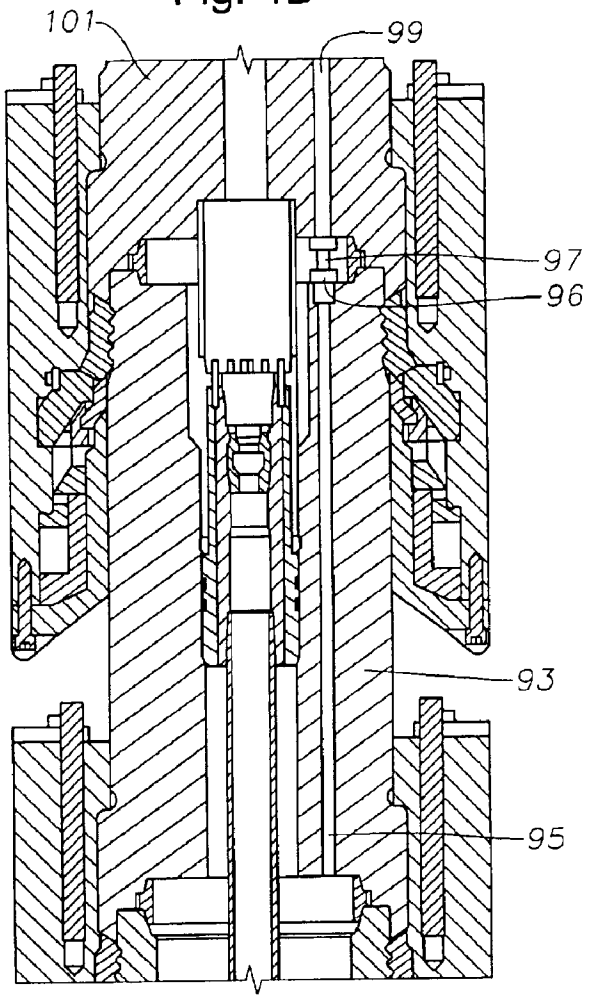
FIGS. 4A and 4B comprise a partial sectional view of a third alternate subsea well constructed in accordance with this invention.
Figure 4A:
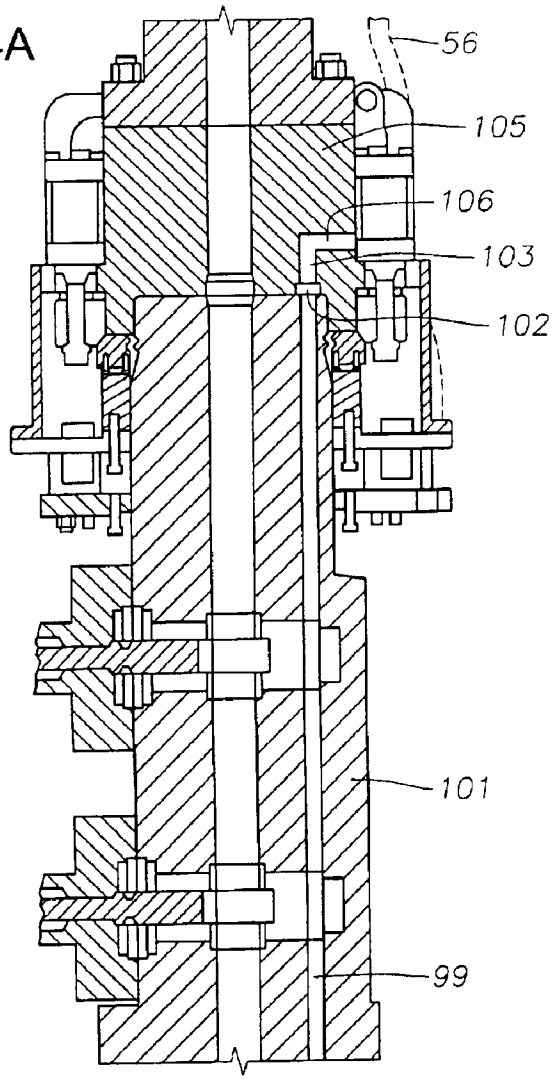

In the embodiment of FIGS. 4A and 4B, tubing spool 93 is shown having a tubing annulus passage 95 extending from the lower end to the upper end in the same manner as the tubing annulus passage 59 of FIG. 2B and tubing annulus passage 73 of FIG. 3B. A stab receptacle 96 is positioned at the upper end of annulus passage 95 on an upper surface of tubing spool 93. Tubing annulus passage 95, however, could exit on the side of tubing spool 93 similar to the embodiment of FIGS. 1A and 1B. A stab 97 at the lower end of tubing annulus passage 99 in valve block 101 will stab into tubing annulus passage 95 through stab receptacle 96, which has a check valve at its upper end. Unlike the other embodiments, however, tubing annulus passage 99 extends completely to the upper end of valve block 101. In the embodiment shown in FIGS. 4A and 4B, tubing annulus passage 95 defines the tubing hanger support portion of the tubing annulus passage, and tubing annulus passage 99 defines the valve block portion of the tubing annulus passage. A stab receptacle 102 is positioned at the end of tubing annulus passage 99 connected to the upper end of valve block 101. A stab 103 extends between passage 99 in valve block 101 and a passage 106 in riser connector 105. Tubing annulus passage 106 leads to the exterior for coupling to conduit 56 extending alongside the riser. When valve block 101 lands on tubing spool 93, it will make up a tubing annulus flow path between passages 106, 99 and 95. A cross-over passage similar to passage 83 of FIG. 3A could be installed between tubing annulus passage 99 and production flow passage 100 in valve block 101. A valve could be mounted in the cross-over passage to selectively communicate tubing annulus passage with production flow passage 100.

Figure 5B:
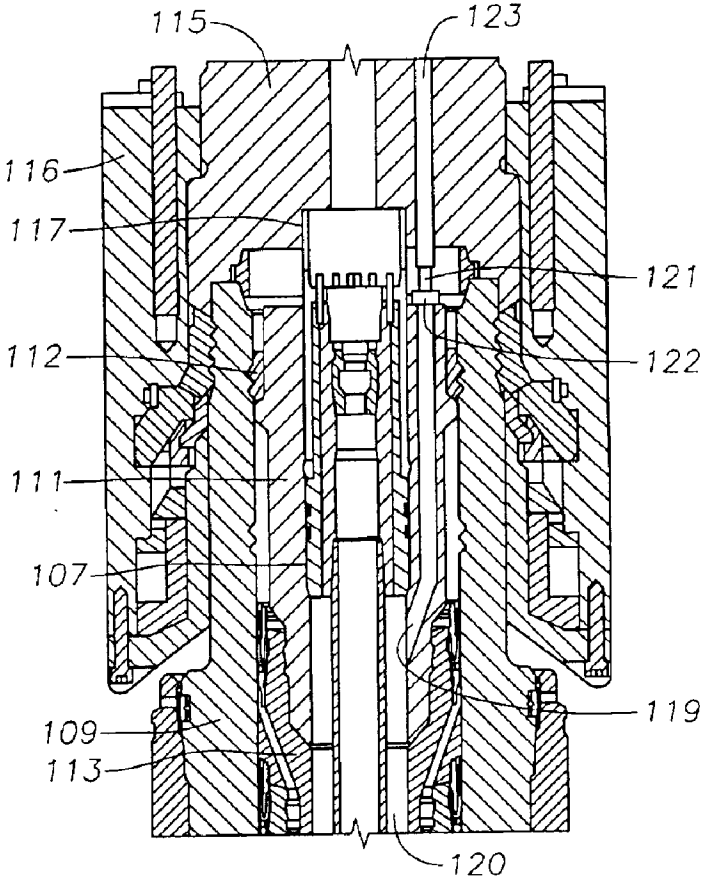
FIGS. 5A and 5B comprise a partial vertical sectional view of a fourth alternate subsea well constructed in accordance with this invention.
Figure 5A:
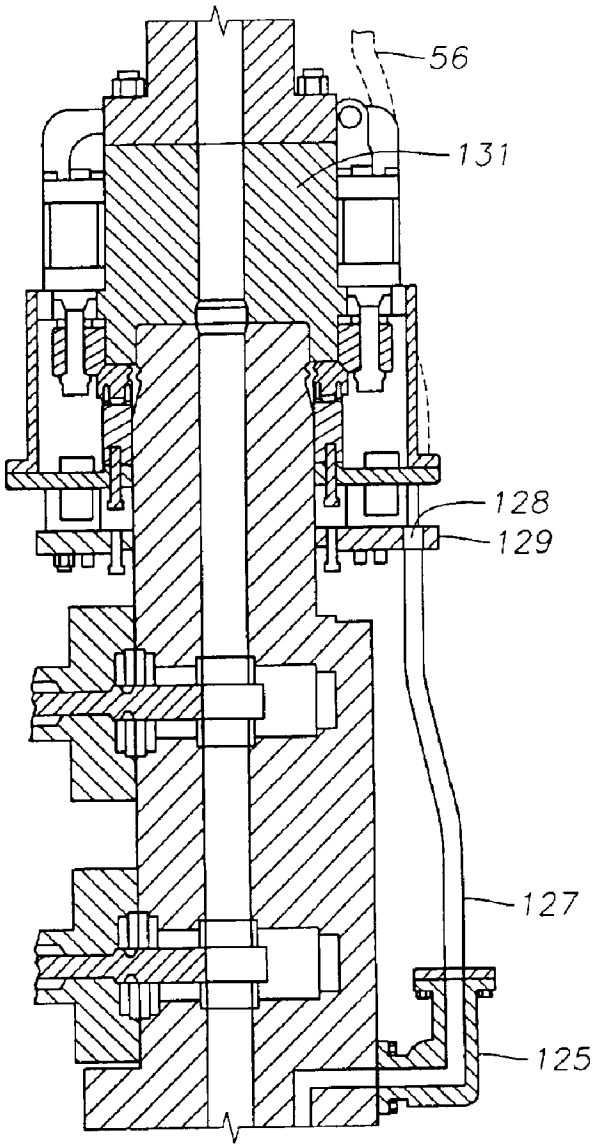

For the first four embodiments (FIGS. 1–4), the tubing hanger support was illustrated as tubing spool 31 (FIG. 1A), 37 (FIG. 2B), 71 (FIG. 3B) or 93 (FIG. 4B). In the embodiment of FIGS. 5A and 5B, there is no tubing spool such as tubing spools 31, 57, 71, 93. Instead, tubing hanger 107 lands in a tubular wellhead member or wellhead housing 109. An adapter 111 is located in the bore of wellhead housing 109 for supporting tubing hanger 107. In the embodiment shown in FIGS. 5A and 5B, adapter 111 defines the tubing hanger support. Adapter 111 has a lower portion that lands in the bore of the upper casing hanger 113. A locking element 112 locks adapter 111 in the bore of wellhead housing 109. A valve block 115 lands on the upper end of wellhead housing 109. A connector 116 connects valve block 115 to an external profile on the mandrel of wellhead housing 109. An isolation sleeve 117 extends between the production passage in valve block 115 and the production passage in tubing hanger 107. A tubing annulus passage 119 extends through adapter 111, having a lower end in communication with the tubing annulus 120 and an upper end in communication with a stab receptacle 122 mounted to adapter 111. A stab 121 extends between the upper end of tubing annulus passage 119 at the upper end of adapter 111, communicating tubing annulus passage 119 with a tubing annulus passage 123 in valve block 115. A check valve that is actuated by stab 121 is at the upper end of tubing annulus passage 119.

Tubing annulus passage 123 of this embodiment leads to an optional annulus valve 125 on the exterior of valve block 115. Alternately, it could lead to a dual valve as in FIGS. 3A and 3B or to the upper end of valve block 115 as in FIGS. 4A and 4B. A conduit 127 on the exterior of valve block 115 leads upward to a stab plate 129 near the upper end of valve block 115. A stab receptacle 128 is positioned at the end of annulus conduit 127 connected to stab plate 129. A riser connector 131 connects to the upper end of valve block 115. Conduit 56 extending alongside the riser from the platform stabs into receptacle 128 on stab plate 129 to connect with tubing annulus conduit 127. In the embodiment shown in FIGS. 5A and SB, tubing annulus passage 119 defines the tubing hanger support portion of the tubing annulus passage, and tubing annulus passage 123 and conduit 127 define the valve block portion of the tubing annulus passage.

In the operation of the embodiment of FIGS. 5A and 5B, the step of landing a tubing spool is eliminated. After the well is drilled and cased, the operator lowers on completion riser tubing hanger 107 and adapter 111, which land in wellhead housing 109. After the well been perforated and tested, the operator sets a plug in the production passage of tubing hanger 107, and then removes the completion riser. The operator then lands valve block 115 on the upper end of wellhead housing 109. Stab 121 will establish communication between adapter passage 119 and valve block passage 123. The communication to the surface is established through conduit 127 and conduit 56 extending downward alongside the riser.

Each of the embodiments described and illustrated above allow an operator to communicate with tubing hanger annulus 29. The operator may circulate heavy fluids into tubing hanger annulus 29 when "killing" the well. It is desirous to have the capability of circulating heavy fluids without having to inject the heavy fluid through string of tubing 27 or through tubing hanger 33. Each embodiment allows operator to circulate heavy fluids through the tubing hanger support (i.e. tubing spools 31, 57, 73, 93 or adapter 111). The operator can also monitor tubing hanger annulus pressure for maintaining and protecting the integrity of the well assembly in case there is a leak.

Further, it will also be apparent to those skilled in the art that modifications, changes and substitutions may be made to the invention in the foregoing disclosure. Accordingly, it is appropriate that the appended claims be construed broadly and in the manner consisting with the spirit and scope of the invention herein. For example, in the embodiment shown in FIGS. 5A and 5B, the valve block portion of the tubing annulus passage could extend completely through valve block 115 rather than being channeled to conduit 127.

What is claimed is:

1. A wellhead assembly, comprising:

a tubular wellhead member in a subsea location;

a tubing hanger for supporting a string of production tubing extending from the tubing hanger to a desired depth, defining a tubing annulus around the outer circumference of the tubing;

a tubing hanger support member which secures the tubing hanger relative to the tubular wellhead member;

a valve block located above the tubular wellhead member and having at least one valve and a valve block passage extending axially therethrough that communicates with the interior of the string of production tubing;

a riser assembly in communication with the tubing, connected to an upper end of the valve block and extending to a platform at the surface of the sea for conveying production fluids flowing through the valve block passage;

a conduit extending from the platform alongside the riser assembly; and a tubing annulus passage extending from the tubing annulus through the tubing hanger support member offset from the tubing hanger and in communication with the conduit.

2. The wellhead assembly of claim 1, further comprising a stab receptacle located at an upper end of the tubing annulus passage; and wherein the conduit stabs into the stab receptacle to communicate with the tubing annulus passage.

3. The wellhead assembly of claim 1, wherein the tubing hanger support member comprises a tubing spool secured to an upper end of the wellhead member.

4. The wellhead assembly of claim 1, wherein the tubing hanger support member comprises an adapter that lands within the wellhead member.

5. A wellhead assembly, comprising:

a tubular wellhead member in a subsea location;

a tubing hanger for supporting a string of production tubing extending from the tubing hanger to a desired depth, defining a tubing annulus around the outer circumference of the tubing;

a tubing hanger support member which secures the tubing hanger relative to the tubular wellhead member;

a riser assembly in communication with the tubing and extending to a platform at the surface of the sea for conveying production fluids;

a conduit extending from the platform alongside the riser assembly;

a tubing annulus passage extending from the tubing annulus through the tubing hanger support member offset from the tubing hanger and in communication with the conduit;

a valve block located between the riser assembly and the wellhead member, having at least one valve and a valve block passage extending axially therethrough that communicates with the interior of the string of production tubing; and wherein a portion of the tubing annulus passage extends through a portion of the valve block.

6. A wellhead assembly, comprising:

a tubular wellhead member in a subsea location;

a tubing hanger for supporting a string of production tubing extending from the tubing hanger to a desired depth, defining a tubing annulus around the outer circumference of the tubing;

a tubing hanger support member which secures the tubing hanger relative to the tubular wellhead member;

a riser assembly in communication with the tubing and extending to a platform at the surface of the sea for conveying production fluids;

a conduit extending from the platform alongside the riser assembly;

a tubing annulus passage extending from the tubing annulus through the tubing hanger support member offset from the tubing hanger and in communication with the conduit;

a valve block located between the riser assembly and the wellhead member, having at least one valve and a valve block passage extending axially therethrough that communicates with the interior of the string of production tubing; and wherein a portion of the tubing annulus passage extends alongside the valve block.

7. A wellhead assembly, comprising:

a tubular wellhead member in a subsea location;

a tubing hanger for supporting a string of production tubing extending from the tubing hanger to a desired depth, defining a tubing annulus around the outer circumference of the tubing;

a tubing hanger support member which secures the tubing hanger relative to the tubular wellhead member;

a riser assembly in communication with the tubing and extending to a platform at the surface of the sea for conveying production fluids;

a conduit extending from the platform alongside the riser assembly;

a tubing annulus passage extending from the tubing annulus through the tubing hanger support member offset from the tubing hanger and in communication with the conduit;

a valve block located above the tubular wellhead member and having a grooved profile connected to the riser assembly, the valve block having at least one valve and a valve block passage extending axially therethrough that communicates with the interior of the string of production tubing; and wherein a portion of the tubing annulus passage extends through the valve block from a lower opening at a lower end of the valve block to an upper opening at the upper end of the valve block.

8. The wellhead assembly of claim 7, further comprising a stab receptacle that is located on the upper opening; and a stab that is in fluid communication with the conduit, which engages the stab receptacle when the riser connects to the grooved profile of the valve block.

9. A wellhead assembly, comprising:

a tubular wellhead member;

a tubing hanger for supporting a string of production tubing defining a tubing annulus around the outer circumference of the tubing;

a tubing hanger support member which secures the tubing hanger relative to the tubular wellhead member;

a valve block located above the tubular wellhead member, having at least one valve and a valve block passage extending axially therethrough for communicating with the string of production tubing;

a production riser extending from a surface platform to an upper end of the valve block, the riser having a production passage for conveying production fluid flowing through the valve block passage between the production tubing and the platform;

a conduit extending from the platform alongside the riser; and a tubing annulus passage extending from the tubing annulus through the tubing hanger support member offset from the tubing hanger and in communication with the conduit.

10. The wellhead assembly of claim 9, wherein the support member comprises an adapter that lands in an inner bore of the tubular wellhead member.

11. The wellhead assembly of claim 9, wherein the support member comprises a tubing spool having a lower portion that lands on and engages a grooved profile on the upper portion of the tubular wellhead member.

12. A wellhead assembly, comprising:

a tubular wellhead member;

a tubing hanger for supporting a string of production tubing defining a tubing annulus around the outer circumference of the tubing;

a tubing hanger support member which secures the tubing hanger relative to the tubular wellhead member;

a valve block located above the tubular wellhead member, having at least one valve and a valve block passage extending axially therethrough for communicating with the string of production tubing;

a production riser extending from a surface platform to the valve block, the riser having a production passage for conveying well fluid to the platform;

a conduit extending from the platform alongside the riser;

a tubing annulus passage extending from the tubing annulus through the tubing hanger support member offset from the tubing hanger and in communication with the conduit;

a valve block stab receptacle connected above the tubing annulus passage to an outer surface of the valve block; and wherein the tubing annulus passage is in communication with the valve block stab receptacle, and the conduit stabs into the valve block stab receptacle for communicating with the tubing annulus passage.

13. The wellhead assembly of claim 12, further comprising a tubing hanger support stab receptacle that is connected to the tubing hanger support member; and a tube extending downward from the valve block receptacle alongside the valve block and having a lower end that stabs into tubing hanger support stab receptacle, thereby communicating with the tubing annulus passage.

14. A wellhead assembly, comprising:

a tubular wellhead member;

a tubing hanger for supporting a string of production tubing defining a tubing annulus around the outer circumference of the tubing;

a tubing hanger support member which secures the tubing hanger relative to the tubular wellhead member;

a valve block located above the tubular wellhead member, having at least one valve and a valve block passage extending axially therethrough for communicating with the string of production tubing;

a production riser extending from a surface platform to the valve block , the riser having a production passage for conveying well fluid to a platform;

a conduit extending from the platform alongside the riser;

a tubing annulus passage extending from the tubing annulus through the tubing hanger support member offset from the tubing hanger and in communication with the conduit;

wherein the support member comprises a tubing spool having a lower portion that lands on and engages a grooved profile on the upper portion of the tubular wellhead member;

wherein the tubing annulus passage further comprises:

a lower portion extending through the tubing spool from the tubing annulus and having an opening at the upper end of the tubing spool; and an upper portion extending through the valve block.

15. A wellhead assembly, comprising:

a tubular wellhead member;

a tubing hanger for supporting a string of production tubing defining a tubing annulus around the outer circumference of the tubing;

a tubing hanger support member which secures the tubing hanger relative to the tubular wellhead member;

a valve block located above the tubular wellhead member, having at least one valve and a valve block passage extending axially therethrough for communicating with the string of production tubing;

a production riser extending from a surface platform to the valve block and having a production passage for conveying well fluid to the platform;

a conduit extending from the platform alongside the riser;

a tubing annulus passage extending from the tubing annulus through the tubing hanger support member offset from the tubing hanger and in communication with the conduit;

wherein the support member comprises a tubing spool having a lower portion that lands on and engages a grooved profile on the upper portion of the tubular wellhead member; a tubular support stab receptacle that is connected to an upper end of the tubing spool; a valve block stab receptacle connected above the tubing annulus passage to an upper end of the valve block, the valve block stab receptacle being in fluid communication with the conduit when the riser connects to the valve block;

wherein the tubing annulus passage further comprises:

a lower portion extending through the tubing spool from the tubing annulus to the tubular support stab receptacle; and a tube having an upper end connected to the valve block stab receptacle and a lower end that stabs into tubular support stab receptacle.

16. A wellhead assembly, comprising:

a tubular wellhead member;

a tubing hanger for supporting a string of production tubing defining a tubing annulus around the outer circumference of the tubing;

a tubing hanger support member which secures the tubing hanger relative to the tubular wellhead member;

a valve block located above the tubular wellhead member, having at least one valve and a valve block passage extending axially therethrough for communicating with the string of production tubing;

a production riser extending from a surface platform to the valve block, the riser having a production passage for conveying well fluid to the platform;

a conduit extending from the platform alongside the riser;

a tubing annulus passage extending from the tubing annulus through the tubing hanger support member offset from the tubing hanger and in communication with the conduit; and wherein the tubing annulus passage further comprises a passage portion extending through the valve block.

17. A wellhead assembly, comprising:

a tubular wellhead member;

a tubing hanger for supporting a string of production tubing defining a tubing annulus around the outer circumference of the tubing;

a tubing hanger support member which secures the tubing hanger relative to the tubular wellhead member;

a valve block located above the tubular wellhead member, having at least one valve and a valve block passage extending axially therethrough for communicating with the string of production tubing;

a production riser extending from a surface platform to the valve block, the riser having a production passage for conveying well fluid to the platform;

a conduit extending from the platform alongside the riser;

a tubing annulus passage extending from the tubing annulus through the tubing hanger support member offset from the tubing hanger and in communication with the conduit; and wherein the tubing annulus passage further comprises a tube extending alongside the valve block.

18. A wellhead assembly, comprising:

a tubular wellhead member;

a tubing hanger for supporting a string of production tubing defining a tubing annulus around the outer circumference of the tubing;

a tubing spool having a lower portion the that lands on and engages a grooved profile on the upper portion of the tubular wellhead member, which secures the tubing hanger relative to the tubular wellhead member;

a valve block located above the tubing spool, having at least one valve and a valve block passage extending axially therethrough for communicating with the string of production tubing;

a production riser extending from a surface platform to the valve block for conveying well fluid between the surface platform and the tubing;

a conduit extending from the platform alongside the riser; and a tubing annulus passage extending from the tubing annulus through the tubing hanger support member offset from the tubing hanger and in communication with the conduit.

19. A wellhead assembly, comprising:

a tubular wellhead member;

a tubing hanger for supporting a string of production tubing defining a tubing annulus around the outer circumference of the tubing;

a tubing spool having a lower portion that lands on and engages a grooved profile on the upper portion of the tubular wellhead member, which secures the tubing hanger relative to the tubular wellhead member;

a valve block located above the tubular wellhead member, having at least one valve and a valve block passage extending axially therethrough for communicating with the string of production tubing, the valve block being adapted to connect to a production riser extending from a platform to the valve block passage for conveying well fluid to the surface platform and being adapted to a connect to a conduit extending from the platform alongside the riser;

a tubing annulus passage extending from the tubing annulus through the tubing hanger support member offset from the tubing hanger and in communication with the conduit; and wherein the tubing annulus passage further comprises a passage portion extending through the valve block.

20. A wellhead assembly, comprising:

a tubular wellhead member;

a tubing hanger for supporting a string of production tubing defining a tubing annulus around the outer circumference of the tubing;

a tubing spool having a lower portion that lands on and engages a grooved profile on the upper portion of the tubular wellhead member, which secures the tubing hanger relative to the tubular wellhead member;

a valve block located above the tubular wellhead member, having at least one valve and a valve block passage extending axially therethrough for communicating with the string of production tubing, the valve block being adapted to connect to a production riser extending from a surface platform to the valve block for conveying well fluid to the platform and being adapted to a connect to a conduit extending from the platform alongside the riser;

a tubing annulus passage extending from the tubing annulus through the tubing hanger support member offset from the tubing hanger and in communication with the conduit; and wherein the tubing annulus passage further comprises a tube extending alongside the valve block.

21. A method of producing a subsea well and communicating with a tubing annulus in the well, comprising the steps:

(a) providing a subsea wellhead assembly with a tubing hanger support member;

(b) lowering a tubing hanger into engagement with the support member, the tubing hanger supporting a string of production tubing that communicate with the valve block passage;

(c) mounting a valve block in the wellhead assembly above the tubing hanger support member, the valve block having a valve and a valve block passage extending axially therethrough (d) providing a tubing annulus passage through the wellhead assembly around the tubing hanger, the tubing annulus passage being in communication with a tubing annulus in the well around the string of production tubing;

(e) connecting a riser assembly from a Christmas tree at the surface of the sea to the valve block;

(f) extending a conduit alongside the riser assembly to the wellhead assembly so that the conduit is in fluid communication with the tubing annulus passage;

(g) opening the valve in the valve block and flowing well fluids up the tubing, the valve block passage and the riser assembly to the platform; and (h) communicating between the surface platform and the tubing annulus through the conduit and the tubing annulus passage.

22. The method of claim 21, wherein step (f) comprises stabbing the conduit into a stab receptacle at an upper end of the tubing annulus passage.

* * * * *

UNITED STATES PATENT AND TRADEMARK OFFICE

CERTIFICATE OF CORRECTION

PATENT NO. : 6,902,005 B2
DATED : June 7, 2005
INVENTOR(S) : Amin Radi et al.

It is certified that error appears in the above-identified patent and that said Letters Patent is hereby corrected as shown below:

Column 2,
Line 28, delete "is" (first occurrence).

Column 3,
Line 35, delete "17" and insert -- 19 --.
Line 36, delete "19" and insert -- 21 --.

Column 7,
Line 49, insert -- the -- before "operator".

Signed and Sealed this

Thirtieth Day of August, 2005

JON W. DUDAS
*Director of the United States Patent and Trademark Office*